US010077094B2

(12) United States Patent
McGuire et al.

(10) Patent No.: US 10,077,094 B2
(45) Date of Patent: Sep. 18, 2018

(54) SYSTEM AND METHOD FOR MOORING A BOAT

(71) Applicant: C and M Manufacturing, Broaddus, TX (US)

(72) Inventors: Anna Marie McGuire, Broaddus, TX (US); James David McGuire, Broaddus, TX (US)

( * ) Notice: Subject to any disclaimer, the term of this patent is extended or adjusted under 35 U.S.C. 154(b) by 0 days.

(21) Appl. No.: 14/293,819

(22) Filed: Jun. 2, 2014

(65) Prior Publication Data

US 2015/0344108 A1 Dec. 3, 2015

(51) Int. Cl.

| | |
|---|---|
| ***B63B 21/00*** | (2006.01) |
| *B63B 29/04* | (2006.01) |
| *A47C 7/62* | (2006.01) |
| *E04H 12/20* | (2006.01) |

(52) U.S. Cl.

CPC ..... *B63B 21/00* (2013.01); *A47C 7/62* (2013.01); *B63B 2021/003* (2013.01); *B63B 2029/043* (2013.01); *E04H 12/20* (2013.01); *Y10T 29/49819* (2015.01); *Y10T 29/49828* (2015.01)

(58) Field of Classification Search

CPC ... B63B 2029/043; B63B 21/10; B63B 21/04; B63B 2021/003; B63B 29/04; E04H 12/20; A47C 7/62

USPC ..... 114/363, 230.1, 230.11, 230.25

See application file for complete search history.

(56) References Cited

U.S. PATENT DOCUMENTS

| | | | | |
|---|---|---|---|---|
| 960,849 | A * | 6/1910 | Gulig | E04H 15/322 135/119 |
| 4,645,167 | A * | 2/1987 | Hardwick | B63B 29/04 248/283.1 |
| 6,659,546 | B2 * | 12/2003 | Schmeing | A47B 37/04 108/50.12 |
| 6,695,407 | B1 * | 2/2004 | Lin | A47C 1/02 248/161 |
| 7,644,945 | B1 * | 1/2010 | Kourkoumelis | B62H 1/12 280/288.4 |

* cited by examiner

*Primary Examiner* — Andrew Polay

(74) *Attorney, Agent, or Firm* — Anna Marie McGuire; James David McGuire

(57) ABSTRACT

A system for a mooring device is herein disclosed. The mooring device comprises a disc and a collar. The disc comprises a central orifice and one or more holes. The central orifice is mountable to a boat seat post. The holes large enough to accommodate a mooring line to pass through. The collar positionable on an end of the disc. A method for mooring a boat is further disclosed. Specifically, the method comprises mounting a mooring device onto a boat seat post. The mooring device comprises a disc and a collar. The disc comprises a central orifice and one or more holes. The central orifice is mountable to the boat seat post. The holes attachable to a mooring line. Further, the method comprises fastening the collar onto the boat seat post.

4 Claims, 12 Drawing Sheets

SYSTEM AND METHOD FOR MOORING A BOAT

BACKGROUND

This disclosure relates to a system and method for mooring a boat.

The mooring of boats has always been a problematic task as it involves the positioning of vessels at a marina berth, dock, slip or any type of structure and securing the mooring lines correctly while being effected by factors such as wave action, tides, winds, and the movement of water by other vessels. Boat mooring assemblies are used to secure a boat in a slip or to a dock, piling, etc., to prevent the boat from floating away and to help minimize damage to the boat. Boats have typically been moored via a cleat along the side secured to the dock by mooring lines. In recent years some boat manufactures have quit putting cleats on the boats creating a need for a means of securing mooring lines to an appropriate location on the boat. There are multiple points on a boat that have the structural capacity to secure a boat to the dock or slip however these points lack the means to easily attach mooring lines.

As such it would be useful to have a system and method for mooring a boat.

SUMMARY

A system for a mooring device is herein disclosed. The mooring device comprises a disc and a collar. The disc comprises a central orifice and one or more holes. The central orifice is mountable to a boat seat post. The holes large enough to accommodate a mooring line to pass through. The collar positionable on an end of the disc.

A method for mooring a boat is further disclosed. Specifically, the method comprises mounting a mooring device onto a boat seat post. The mooring device comprises a disc and a collar. The disc comprises a central orifice and one or more holes. The central orifice is mountable to the boat seat post. The holes attachable to a mooring line. Further, the method comprises fastening the collar onto the boat seat post.

A boat seat is herein disclosed. The boat seat comprises a seat portion, a boat seat post, and attachment. The boat seat post that supports the seat portion. The attachment comprises a mounting portion that mounts the attachment to the boat seat post, and one or more ring portions, each of the ring portions large enough for a mooring line to pass through.

DETAILED DESCRIPTION

Described herein is a system and method for mooring a boat. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
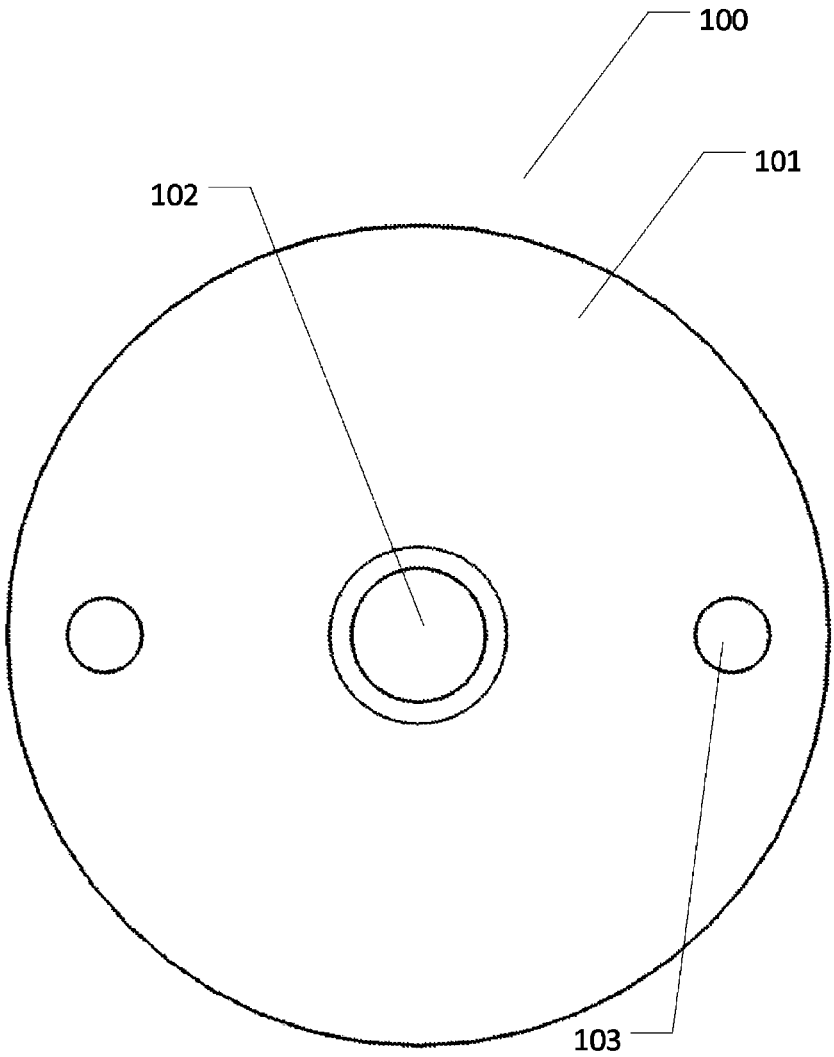
FIG. 1A illustrates a top view of a mooring device comprising a disc, a central orifice, and one or more holes.

FIG. 1A illustrates a top view of mooring device 100 comprising a disc 101, a central orifice 102 and one or more holes 103. Disc 101 can be a rigid plate made materials such as steel or aluminum. Central orifice 102 can be a hole placed at the center of mooring device 100. Furthermore, central orifice 102 can have a diameter large enough to fit a boat seat pedestal or a boat post. Holes 103 can be placed axially around central orifice 102, such that each hole 103 can be a distance away from the edge of disc 101. In one embodiment, holes 103 can be ½ inch away from the edge of disc 101. For purposes of this disclosure, it is not necessary that disc 10 be circular. For example, disc 101 could be oval, square, or rectangular. However, in a preferred embodiment, disc 101 would be round so as to not have corners, which could cause injury to those on a boat.

Figure 1B:
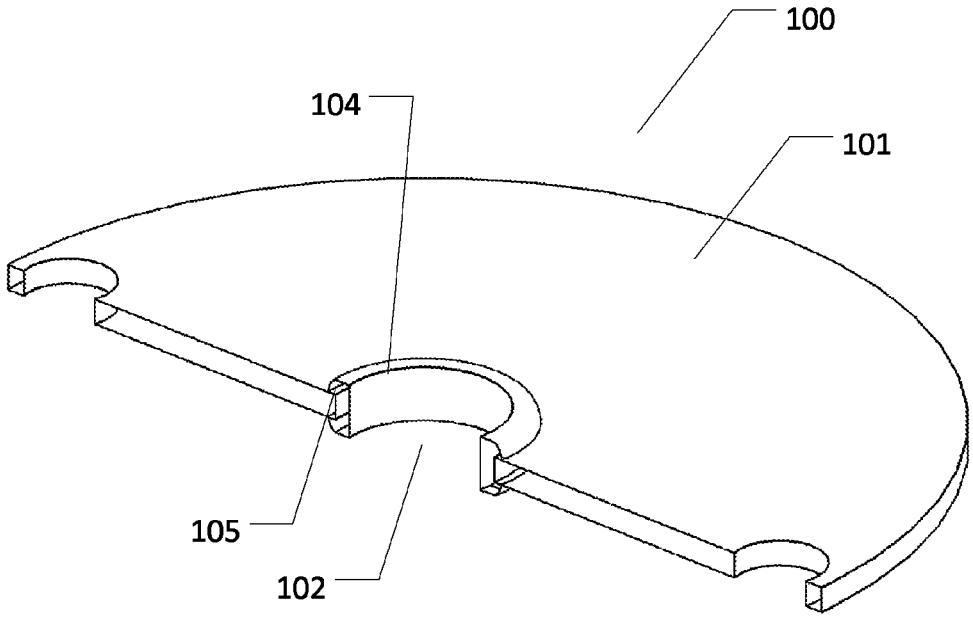
FIG. 1B illustrates a sectional view of a disc.

FIG. 1B illustrates a sectional view of disc 101. In this embodiment, mooring device 100 can further comprise a ring 104. Ring 104 can be used to reduce noise or dampen vibrations. Ring 104 can comprise lips 105. Lips 105 can be protruding portions of ring 104, which can prevent ring 104 from slipping out of central orifice 102. In one embodiment, ring 104 can be a grommet device that is inserted into central orifice 102. As such, ring 104 can be made of a durable material such as rubber, plastic, or metal.

Figure 2:
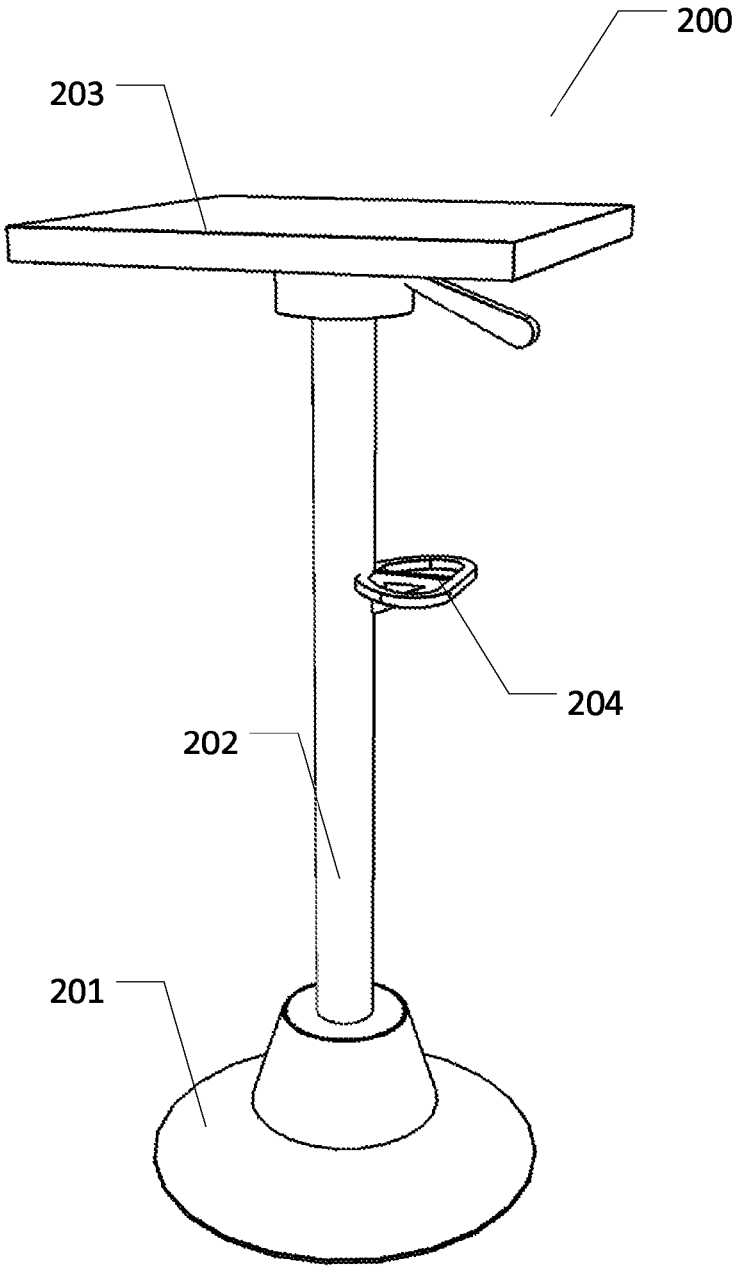
FIG. 2 illustrates a boat seat pedestal.

FIG. 2 illustrates a boat seat pedestal 200. For purposes of this disclosure, boat seat pedestal 200 can be a common structure found in a boat. Boat seat pedestal 200 are usually a preferred seating structure since boat seat pedestal 200 takes less space, thus can be installed in a boat with limited space. Moreover, the seat on boat seat pedestal 200 can have the capacity to turn, allowing the user to rotate the seat in any direction. Further, boat seat pedestal 200 can comprise a base 201, a post 202, and a seat 203. Base 201 can be the foundation of boat seat pedestal 200. As such, base 201 can be securely fixed onto the surface of a boat. Post 202 can be securely mounted into base 201. Post 202 can be a long cylindrical shaft that is usually made of metal. Seat 201 can be any flat surface that is used for seating. Seat 201 can be a removable portion of boat seat pedestal 200 that is mountable onto post 202. In one embodiment, boat seat pedestal 200 can further comprise an attachment 204. Attachment 204 can be a portion in boat seat pedestal 200 that can be used as a connection point. In such embodiment, attachment 204 can be used to secure and moor boat seat pedestal 200 directly to the boat. In another embodiment, boat seat pedestal 200 can have a structural capacity to secure a boat. In this embodiment, boat seat pedestal 200 can be used as an anchor point for a boat. As such, seat 203 can be removed from boat set pedestal 200 to mount mooring device 100.

Figure 3:
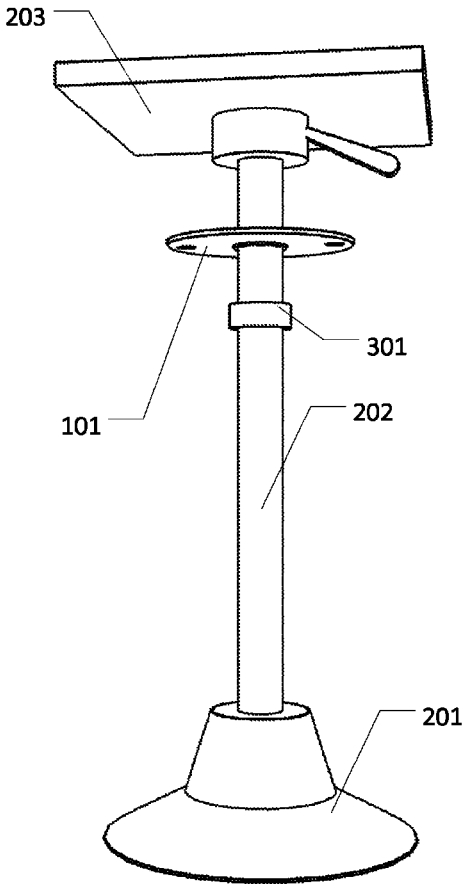
FIG. 3 illustrates an embodiment of mooring device comprising a collar.

FIG. 3 illustrates an embodiment of mooring device 100 comprising a collar 301. In this embodiment, collar 301 and disc 101 can be a separate device. In such embodiment, collar 301 can be used to lock mooring device 100 in place. In such embodiment, collar 301 can be placed on any end of said disc 101. As such, collar 301 can be positioned on top or at the bottom of disc 101. Placing collar 301 on top of disc 101 can prevent mooring device 100 from sliding towards seat 203 while placing collar 301 at the bottom of disc 101 can ensure that disc 101 does not slide towards base 201 of boat seat pedestal 200.

Figure 4:
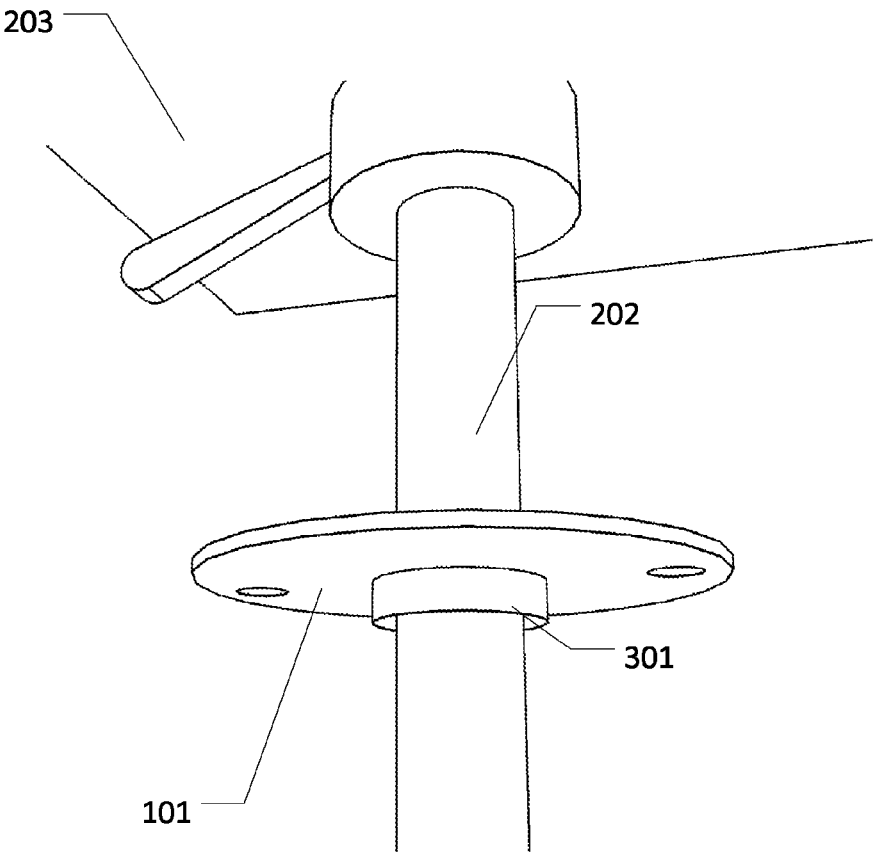
FIG. 4 illustrates another embodiment of a mooring device.

FIG. 4 illustrates another embodiment of mooring device 100. In this embodiment, disc 101 and collar 301 can be a single device. In one embodiment, collar 301 can be a fixed portion of or unibody with disc 101. In another embodiment, collar 301 can be permanently attached to disc 101 through methods that can include but are not limited to molding, welding, cementing, or use of any adhesive materials. In such embodiment, mooring device 100 can be securely attached within post 202 through collar 301. Thus, preventing mooring device 100 from sliding within post 202.

Figure 5:
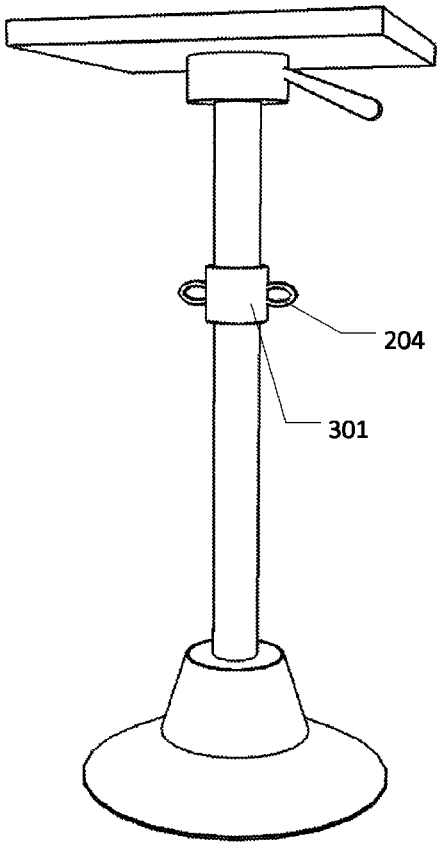
FIG. 5 illustrates an embodiment of a collar comprising attachments.

FIG. 5 illustrates an embodiment of collar 301 comprising attachments 204. In this embodiment, attachments 204 can be directly placed around the middle section of collar 301. In one embodiment attachments 204 can protrude from collar 301. As such attachments 204 can extend from collar 301. In another embodiment, attachments 204 can be orifices placed around collar 301.

Figure 6A:
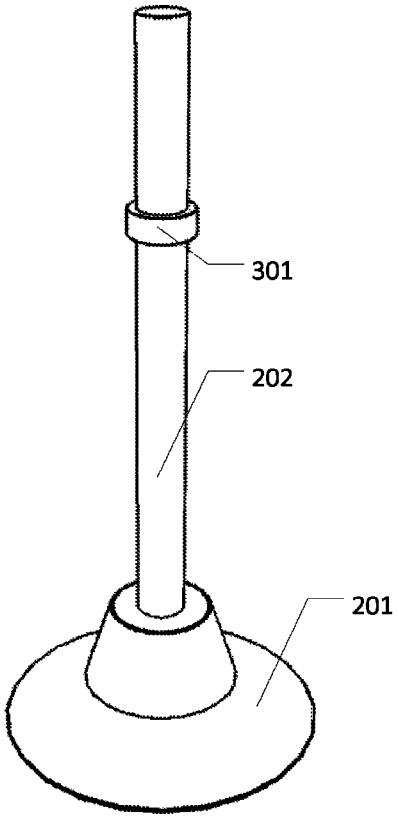
FIG. 6A illustrates how to mount a mooring device onto a boat seat pedestal.

FIG. 6A illustrates how to mount mooring device 100 onto boat seat pedestal 200. Firstly, seat 203 can be removed from boat seat pedestal 200. In an embodiment wherein disc 101 can be a separate device from collar 301, collar 301 can be first inserted onto post 202 to secure the position of disc 101 in post 202. To ensure that collar 301 is secured onto post 202 a fastening device 601 can be used to securely fasten collar 301 around post 202. Fastening device 505 can include but is not limited to screws, nuts and bolts. In another embodiment wherein disc 101 and collar 301 can be a unibody, after removing seat 203 mooring device 100 can be mounted onto post 202. Then, collar 301 can be tightly fastened around post 202 using fastening device 601.

Figure 6B:
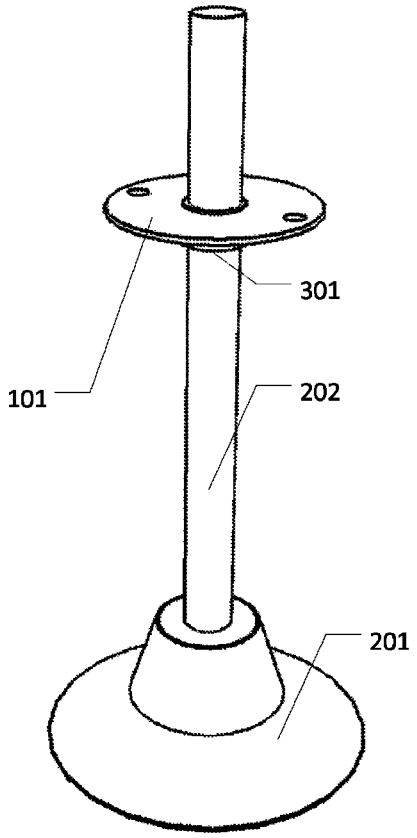
FIG. 6B illustrates a disc mounted on top of a collar.

FIG. 6B illustrates disc 101 mounted on top of collar 301. Central orifice 102 can be positioned on top of post 202. Then, disc 101 can slide within post 202 resting on top of collar 301. As such, mooring device 100 can be held on a fixed position within post 202.

Figure 6C:
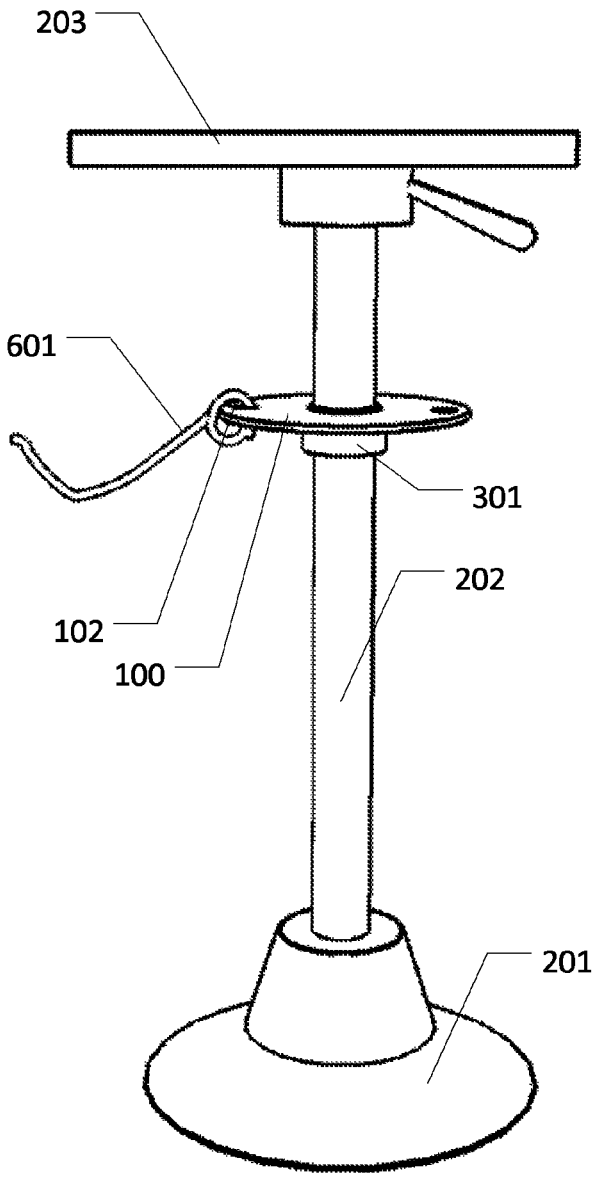
FIG. 6C illustrates a mooring device mounted within a post wherein seat is remounted in place.

FIG. 6C illustrates mooring device 100 mounted within post 202 wherein seat 203 is remounted in place. Once mooring device 100 is placed on a desired position within post 202, seat 203 can be remounted on top of post 202. Collar 301 can ensure that mooring device 100 is secured in place. After securing mooring device 100 within boat seat pedestal 200, the ends of a mooring line 600 can be fastened within holes 103 of disc 101.

Figure 7:
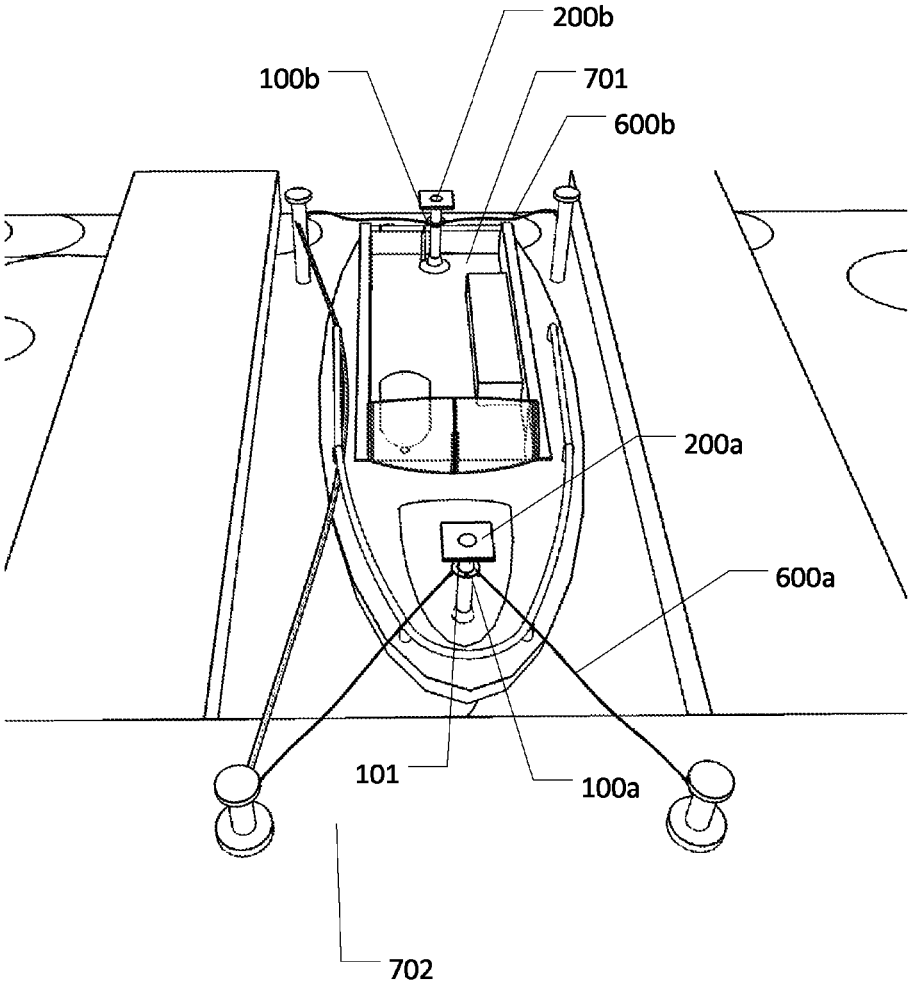
FIG. 7 illustrates an embodiment of a boat secured to a dock slip through discs of a mooring device.

FIG. 7 illustrates an embodiment of boat 701 secured to a dock slip 702 through discs 101 of mooring device 100. For the purpose of this disclosure, boat 701 can comprise at least two boat seat pedestals 200. As such, a first boat seat pedestal 200*a* can be placed in front of boat 701 while a second boat seat pedestal 200*b* can be positioned at the rear of boat 701. In an embodiment wherein mooring device 100 can be in use, a first mooring device 100*a* can be mounted on boat seat pedestal 200*a* while a second mooring device 100*b* can be attached to boat seat pedestal 200*b*. In one embodiment, boat 701 can be moored to dock slip 702 through disc 101. As such, a first mooring line 600*a* can be fastened into holes 103 of first mooring device 100*a* then attached to a first set of stern fixtures 703*a* on dock slip 702. Furthermore, a second mooring line 600*b* can also be fastened into holes 103 of second mooring device 100*b*, which can then be attached to a second set of stern fixtures 703*b*. In such mooring method, boat 701 can be properly moored onto dock slip 702.

Figure 8:
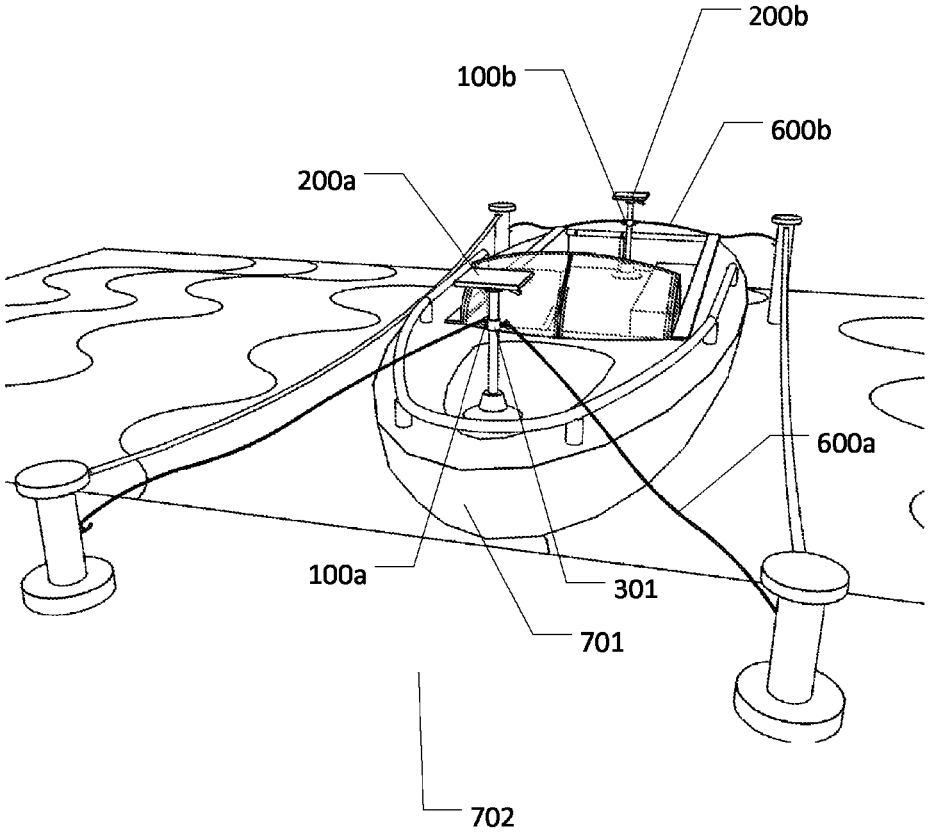
FIG. 8 illustrates another embodiment wherein a boat can be moored to a dock slip through a collar.

FIG. 8 illustrates another embodiment wherein boat 701 can be moored to dock slip 702 through collar 301. A first mooring line 600*a* can be fastened into attachments 204 of first mooring device 100*a* then attached to a first set of stern fixtures 703*a* on dock slip 702. Moreover, a second mooring line 600*b* can be fastened into attachments 204 of second mooring device 100*b*, which can then be attached to a second set of stern fixtures 703*b*.

Figure 9:
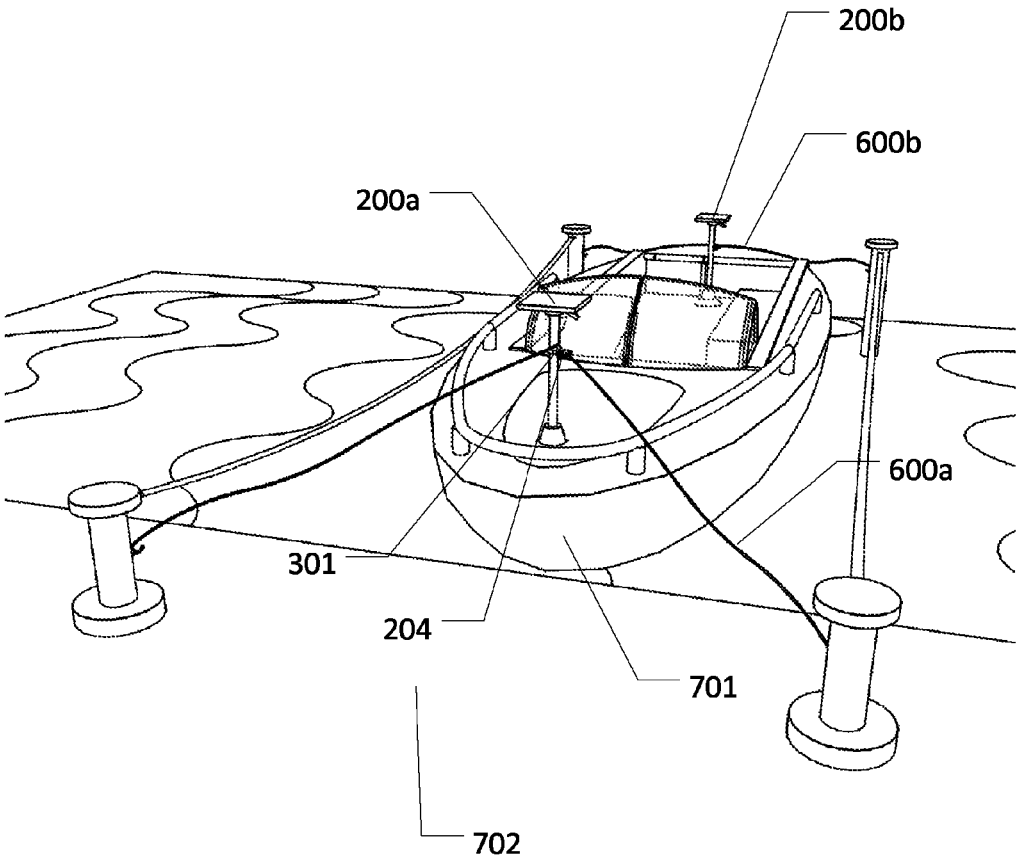
FIG. 9 illustrates another embodiment wherein a boat can be moored directly to a boat seat pedestal.

FIG. 9 illustrates another embodiment wherein boat 701 can be moored directly to boat seat pedestal 200. In an embodiment wherein boat seat pedestal 200 further comprises attachments 204, boat 701 can be moored to a dock through mooring lines 600. In such embodiment attachments 204 can be securely fixed onto boat seat pedestal 200. The same method of mooring can be applied when fastening boat 701 onto dock slip 702.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A method for mooring a boat comprising mounting a mooring device onto a boat seat post, wherein said mooring device comprising a disc comprising a central orifice and one or more holes, wherein said central orifice mountable to said boat seat post, further wherein said holes attachable to a mooring line; and a collar positionable on an end of said disc;

fastening said collar onto said boat seat post; and passing a mooring line through one of said holes and connecting at least one of the ends of said mooring line to a position outside of said boat.

2. The method of claim 1 wherein said collar is unibody with said disc.

3. The method of claim 1 prior to mounting said mooring device comprising the step of removing a boat seat from said boat seat post.

4. The method of claim 3 further comprising the step of remounting said boat seat onto said boat seat post.

* * * * *